US007861369B2

(12) United States Patent
Miner et al.

(10) Patent No.: US 7,861,369 B2
(45) Date of Patent: Jan. 4, 2011

(54) BELT DISENGAGING DEVICE FOR A VACUUM CLEANER

(75) Inventors: Jonathan L. Miner, Rockford, MI (US); George Moyher, Cedar Springs, MI (US)

(73) Assignee: BISSELL Homecare, Inc., Grand Rapids, MI (US)

( * ) Notice: Subject to any disclaimer, the term of this patent is extended or adjusted under 35 U.S.C. 154(b) by 489 days.

(21) Appl. No.: 11/556,522

(22) Filed: Nov. 3, 2006

(65) Prior Publication Data

US 2007/0056137 A1 Mar. 15, 2007

Related U.S. Application Data

(63) Continuation-in-part of application No. PCT/US2006/02669, filed on Jul. 11, 2006.

(60) Provisional application No. 60/595,515, filed on Jul. 12, 2005.

(51) Int. Cl.
*A47L 5/10* (2006.01)

(52) U.S. Cl. ..... 15/390

(58) Field of Classification Search ..... 15/391, 15/390, 332, 333
See application file for complete search history.

(56) References Cited

U.S. PATENT DOCUMENTS

| | | | | |
|---|---|---|---|---|
| 1,448,349 | A | | 3/1923 | Hoover |
| 2,094,138 | A | | 9/1937 | White |
| 2,322,223 | A | | 6/1943 | Coss |
| 2,449,997 | A | | 9/1948 | Hahn et al. |
| 2,601,698 | A | | 7/1952 | Humphrey |
| 2,682,680 | A | | 7/1954 | Trimble |
| 4,446,594 | A | | 5/1984 | Watanabe et al. |
| 5,537,712 | A | * | 7/1996 | Weber et al. ..... 15/391 |
| 5,839,160 | A | | 11/1998 | Wang et al. |
| 6,067,689 | A | | 5/2000 | Roney et al. |
| 6,098,243 | A | | 8/2000 | Kim |
| 6,131,238 | A | * | 10/2000 | Weber et al. ..... 15/340.3 |
| 6,158,084 | A | | 12/2000 | Weber |
| 6,374,453 | B1 | | 4/2002 | Kim |
| 6,915,544 | B2 | * | 7/2005 | Roney et al. ..... 15/384 |
| 7,107,647 | B2 | | 9/2006 | Park |
| 7,120,964 | B2 | * | 10/2006 | Roney ..... 15/391 |
| 7,562,415 | B2 | | 7/2009 | Moon |
| 2004/0200031 | A1 | | 10/2004 | Park |

FOREIGN PATENT DOCUMENTS

| | | | |
|---|---|---|---|
| DE | 654927 | C | 1/1938 |
| JP | 57131420 | A | 8/1982 |
| WO | 9829021 | A | 7/1998 |

* cited by examiner

*Primary Examiner*—Dung Van Nguyen
(74) *Attorney, Agent, or Firm*—McGarry Bair PC

(57) ABSTRACT

A vacuum cleaner comprises a motor-driven rotatable agitator coupled with a shaft of the motor through a belt. A belt disengaging device for a vacuum cleaner comprises a pin that is movable through an arc of less than 180° between an engaged position and a disengaged position, at which the pin lifts the belt off the motor shaft. An actuator for the belt disengaging device includes a first exterior portion for user access and is moveable between a first and second position. A linkage pivotally connected to the actuator and the mechanically coupled to the pin moves the pin between the engaged and disengaged positions as the actuator moves between the first and second positions.

20 Claims, 11 Drawing Sheets

BELT DISENGAGING DEVICE FOR A VACUUM CLEANER

CROSS REFERENCE TO RELATED APPLICATIONS

This application is a continuation-in-part of PCT Application Serial No. PCT/US2006/02669, filed Jul. 11, 2006, which claims the benefit of U.S. provisional application Ser. No. 60/595,515, filed Jul. 12, 2005, both of which is incorporated herein by reference in its entirety.

BACKGROUND OF THE INVENTION

1. Field of the Invention

This invention generally relates to vacuum cleaners, and more specifically to a belt disengaging device for an upright vacuum cleaner.

2. Description of the Related Art

Upright vacuum cleaners with rotating agitators are often provided with a device for stopping agitator motion by disengaging the agitator belt drive. Such belt disengaging devices physically disengages the agitator drive belt from the motor shaft but the vacuum motor continues to run. This process is useful when the vacuum cleaner is used for cleaning uncarpeted or bare floors, including hardwood, linoleum, tile, and tatami floors. Otherwise, the rotating agitator can generate air currents that push lightweight dust and debris away from the agitator so that they are not drawn through the suction nozzle and collected. A rotating agitator can also damage certain bare floors. It is also often desirable to disengage the agitator belt drive when the vacuum cleaner is left stationary and used for above-the-floor cleaning, as even more robust floor coverings might be damaged by the rotating agitator.

One general type of belt disengager is a "belt shifter", where the agitator drive belt is shifted laterally from a driven pulley to an idler pulley. Both pulleys are usually on the end of the agitator brush roll. The agitator drive belt continues to run on the idler pulley, but does not engage the brush roll. Examples of belt shifters are disclosed in U.S. Pat. No. 2,682,680 to Trimble, U.S. Pat. No. 4,446,594 to Watanabe et al., and U.S. Pat. No. 5,839,160 to Wang et al., which are incorporated herein by reference in their entirety.

Another general type of belt disengager is a "belt tightener". In these types of agitator drive belt systems, the drive belt is slack around an agitator drive pulley and a motor driven pulley, and thus the agitator will not rotate. To engage the belt, a belt tightener such as a pulley or a wheel is brought against the belt to take up the slack in the belt, thereby causing the agitator to rotate. Examples of belt tighteners are disclosed in U.S. Pat. No. 2,601,698 to Humphrey and U.S. Pat. No. 6,374,453 to Kim, which are incorporated herein by reference in their entirety.

A third general type of brush belt disengager is a "belt lifter", wherein a member engages the belt to lift it away from a driven pulley or other driven member connected to the drive shaft of a motor. Examples of belt lifters are disclosed in U.S. Pat. No. 2,094,138 to White, U.S. Pat. No. 2,322,223 to Coss, U.S. Pat. No. 6,067,689 to Roney et al., and U.S. Pat. No. 6,098,243 to Kim, which are incorporated herein by reference in their entirety.

SUMMARY OF THE INVENTION

A vacuum cleaner according to the present invention comprises a base assembly having a housing, a suction nozzle, a rotatable agitator, a motor-driven belt drive for the rotatable agitator comprising a motor shaft and a belt coupling the motor shaft to the rotatable agitator, a suction source in fluid communication with the suction nozzle, and a belt drive disengaging assembly. The belt drive disengaging assembly comprises a bracket mounted within the housing, a pin associated with the bracket and moveable through an arc of substantially less than 180° between an engaged position, where the motor shaft is coupled to the agitator through the belt, and a disengaged position, where the pin lifts the belt off the motor shaft, an actuator mounted to the bracket for movement between a first and a second position, and including a first portion positioned exterior of the housing for user access and a second portion positioned interior of the housing, and a linkage pivotally connected to the actuator and mechanically coupled to the pin to move the pin between the engaged and disengaged positions, upon the actuator moving between the first and second positions, respectively.

According to one aspect of the present invention, the first portion of the actuator comprises a foot pedal. The second portion of the actuator can be pivotally coupled with the linkage. The actuator can be pivotally mounted to the bracket for movement between the first and second position by rotation of the first portion. The actuator can rotate less than 90° when moving between the first and second position.

According to another aspect of the invention, the linkage comprises a link having a first end pivotally connected to the actuator and a second end pivotally connected to a cam mounting the pin. The pin can be guided in a slot formed in the bracket for movement between the engaged and disengaged positions. The second end of the link can be further pivotally connected to a second cam mounting a second pin associated with the bracket, the second pin being moveable between the engaged position and the disengaged position, where the second pin lifts the belt off the motor shaft contemporaneously with the first pin. The first and second cams can be pivotally connected to the link by a pivot pin guided in a third slot formed in the bracket. The first and second pins can each comprise a shaft and a bearing roller mounted to the shaft and adapted to engage the belt. The second pin can be guided in a second slot formed in the bracket for movement between the engaged and disengaged positions. The first and second slots can be formed in the bracket relative to opposite sides of the motor shaft. The first and second slots can be concave toward the motor shaft.

According to yet another aspect of the invention, the cam can is pivotally connected to the bracket. The pivot axis of the cam can be offset from the rotational axis of the motor shaft. The pin can comprise a body portion adapted to engage the belt and a winglet adapted to prevent the belt from slipping off the body portion. The pin can be guided in a slot formed in the bracket for movement between the engaged and disengaged positions. The slot can be concave toward the motor shaft.

Figure 15:
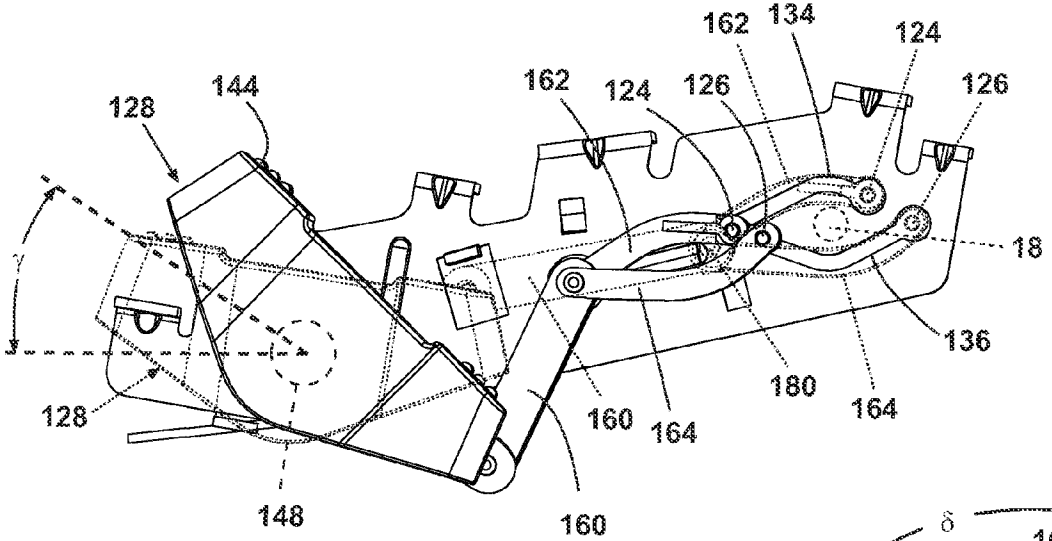
FIG. 15 is a side view of the belt disengaging device from FIG. 9, illustrating the movement of the device between an engaged and a disengaged position.

15A is an enlarged view of a portion of the belt disengaging device from FIG. 15.

DESCRIPTION OF THE PREFERRED EMBODIMENT

Figure 1:
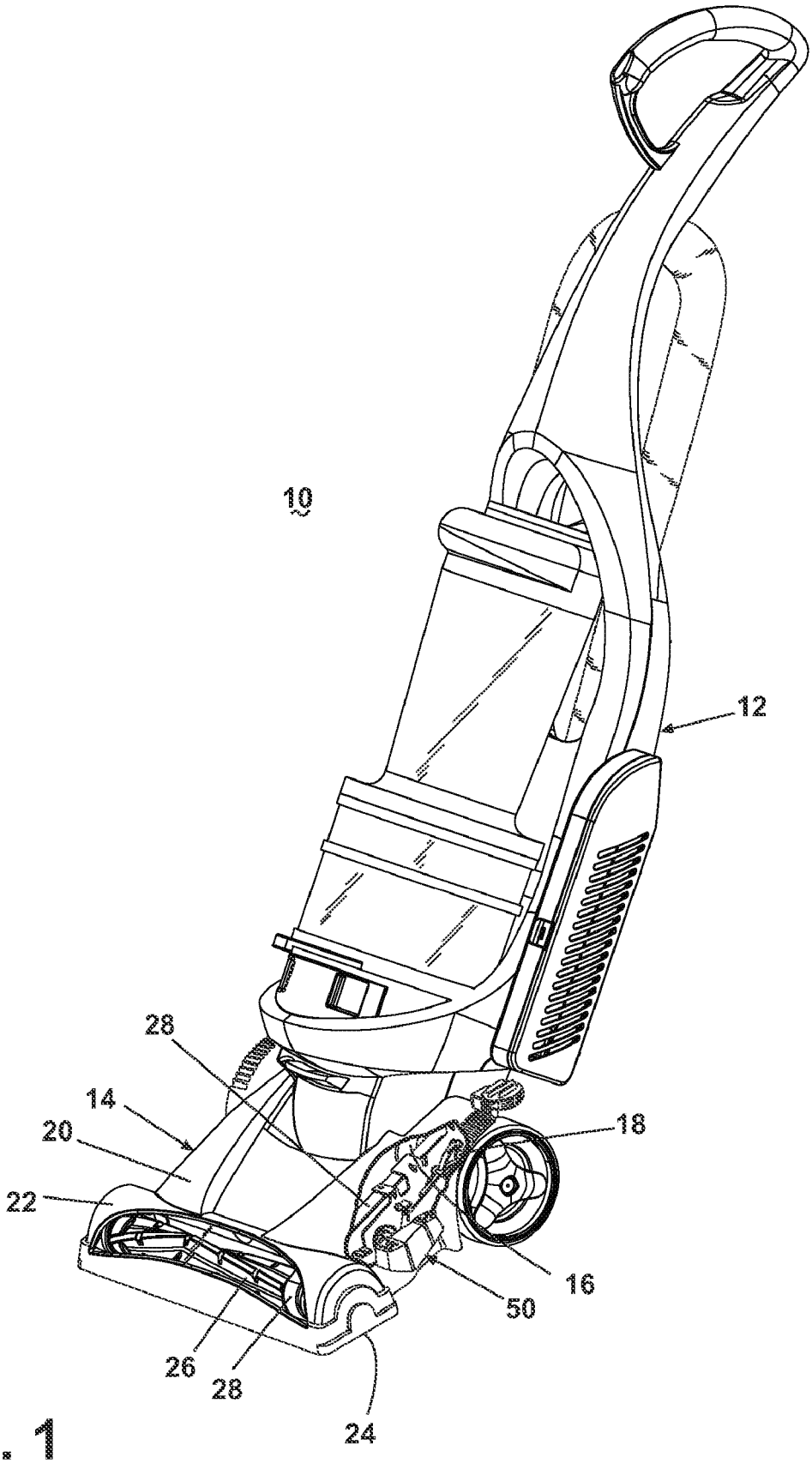
FIG. 1 is a perspective view of a vacuum cleaner having a belt disengaging device according to the present invention.

An exemplary upright vacuum cleaner 10 having a belt disengaging device 50 according to the present invention is shown in FIG. 1. The vacuum cleaner generally comprises an upright assembly 12 pivotally mounted to a base assembly 14. The upright assembly 12 contains a commonly known motor/fan assembly 16 orientated traversely within a lower end of the upright assembly 12. The motor/fan assembly 16 creates suction for drawing dirt and debris from the surface to be cleaned and also drives an agitator 26 located in the base assembly 14. The upright assembly 12 pivots relative to the base assembly 14 through an axis formed relative to a drive shaft 18 of the motor 16. The drive shaft 18 projects into the base assembly 14 and interacts with the belt disengaging device 50 as will be described below. The base assembly 14 generally comprises a housing 20 and with a brush chamber 22 formed on a forward portion of the housing 20. A suction nozzle 24 is formed at a lower surface of the brush chamber 22 and is in fluid communication with the surface to be cleaned. The rotating agitator 26 is positioned within the brush chamber 22 and is operably coupled to the drive shaft 18 by a belt 28. The belt disengaging device 50 is substantially located within the base assembly 14 and can uncouple the agitator 26 from the drive shaft 18. Specifically, the belt disengaging device lifts the belt 28 out of engagement with the drive shaft 18 so that the motor 16 can remain energized while rotation of the agitator 26 is ceased. This is particularly useful when performing an above-the-floor cleaning operation, where suction created by the motor 16 is necessary but agitator rotation is not needed, or when cleaning bare floors, where a rotating agitator can reduce cleaning efficiency.

While the motor 16 is illustrated as being positioned within the upright assembly 12, it is also within the scope of the invention for the motor 16 to be located in the base assembly 14. Furthermore, the upright vacuum cleaner 10 can comprise other elements that are common in the art, but which are not discussed herein for the sake of brevity.

Figure 2:
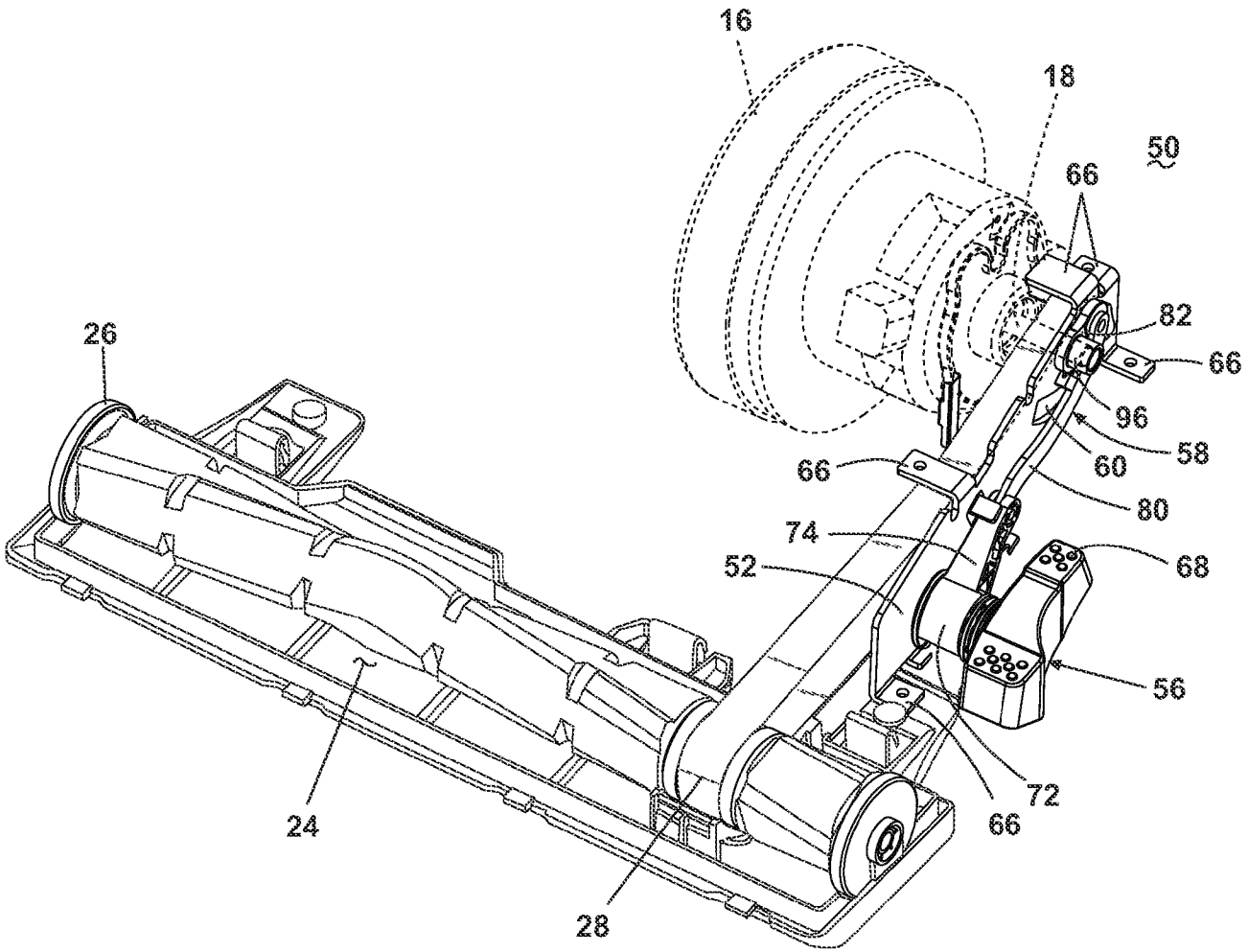
FIG. 2 is a front perspective view of a first embodiment of the belt disengaging device from FIG. 1.
Figure 3:
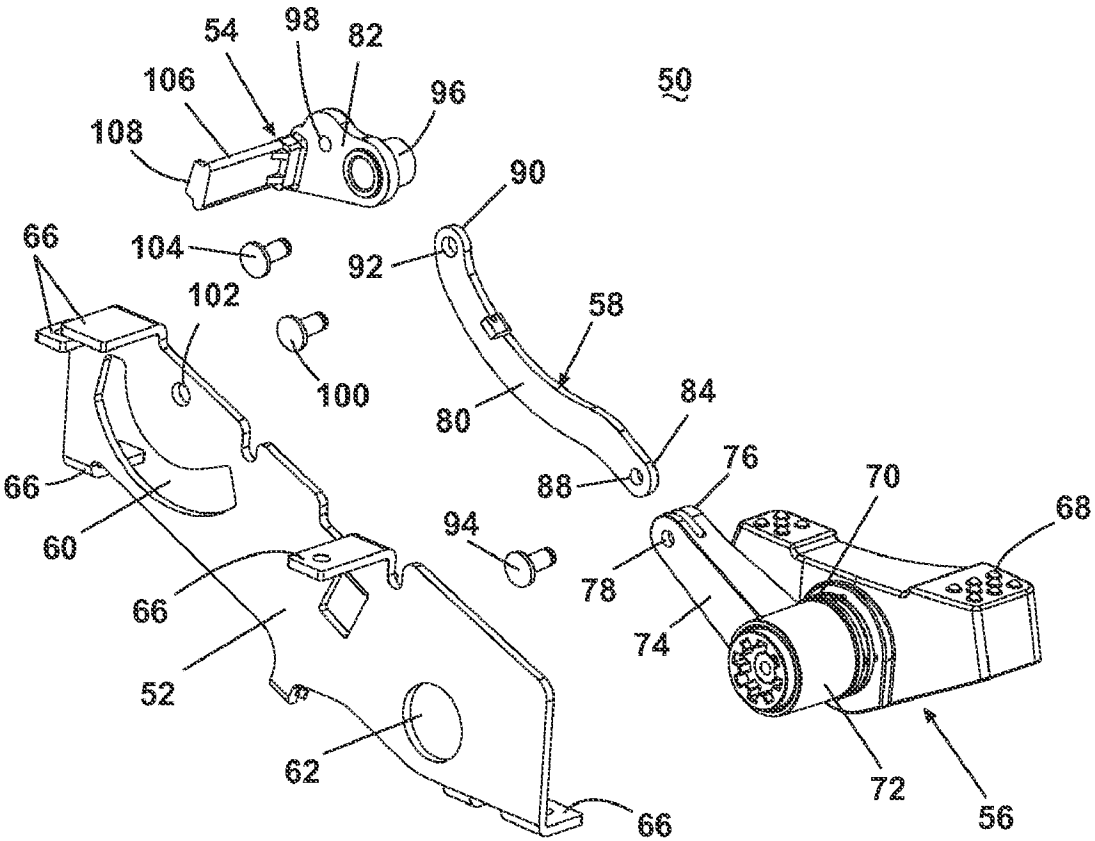
FIG. 3 is an exploded view of the belt disengaging device from FIG. 2

Referring to FIG. 2-8, a first embodiment of the belt disengaging device 50 according to the present invention is shown. Referring particularly to FIGS. 2-3, the belt disengaging device 50 generally comprises a bracket 52, a belt disengaging pin 54 for disengaging the belt 28 from the motor shaft 18, an actuator 56 for manually actuating the belt disengager 50, and a linkage 58 between the belt disengaging pin 546 and the actuator 56.

The bracket 52 comprises an arcuate slot 60 near one end and a circular opening 62 near the opposite end. A tab 64 projects from one side of the bracket 52. The slot 60 and the tab 64 limit the range of motion for the belt disengaging device 50. The circular opening 62 mounts the actuator 56 to the bracket 52. The bracket 52 further comprises a plurality of flanges 66 that facilitate mounting the bracket 52 within the housing 20 of the base assembly 14 using screws (not shown). The bracket 52 generally supports the components of the belt disengaging device 50 within the base assembly 14.

The actuator 56 comprises a first portion 68 that projects exteriorly of housing 20 of the base assembly 14 and a second portion 70 that is interior of the housing 20. As illustrated, the first portion 68 conveniently comprises a foot pedal for actuation by the foot of a user. The first portion 68 could alternately comprise a switch for actuation by the hand of the user. The second portion 70 comprises a shaft 72 having a rear orthogonal extension 74 with a bifurcated end 76 having two arms and a hole 78 formed therethrough. The shaft 72 is retained within the circular opening 62 to rotatably couple the actuator 56 to the bracket 52.

The linkage 58 comprises a link rod 80 and a cam plate 82. The link rod 80 comprises a generally straight member with a first end 84 having a hole 88, and a second end 90 having a hole 92. The first end 84 is positioned between the arms of the bifurcated end 76 of the rear extension, with the holes 78, 88 aligned and receiving a first pivot pin 94 for pivotally coupling the rear extension 74 to the linkage 58. The cam plate 82 comprises a body having a screw boss 96 formed near one end thereof and a hole 98 spaced from the screw boss 96. The cam plate 82 is pivotally coupled to the link rod 80 by a second pivot pin 100 extending through aligned holes 92 and 98. The cam plate 82 is positioned with the screw boss 96 aligned with a hole 102 formed in the bracket 52, above the arcuate slot 60, and is pivotally coupled to the bracket 52 by a third pivot pin 104 extending through the screw boss 96 and the hole 100.

The belt disengaging pin 54 comprises a generally flat body 106 extending normally from one surface of the cam plate 82, such that it extends through the arcuate slot 60, and a winglet 108 that extends orthogonally from the flat body 106. The winglet 108 prevents the belt 28 from slipping off the flat body 106 when moving the belt disengaging pin 54 between an engaged and disengaged position. The belt disengaging pin 54 is slidingly received in the arcuate slot 60 and is moveable through length of the slot 60 to disengage the belt 28 from the motor shaft 18 by operation of the belt disengaging device 50 as follows.

Figure 4:
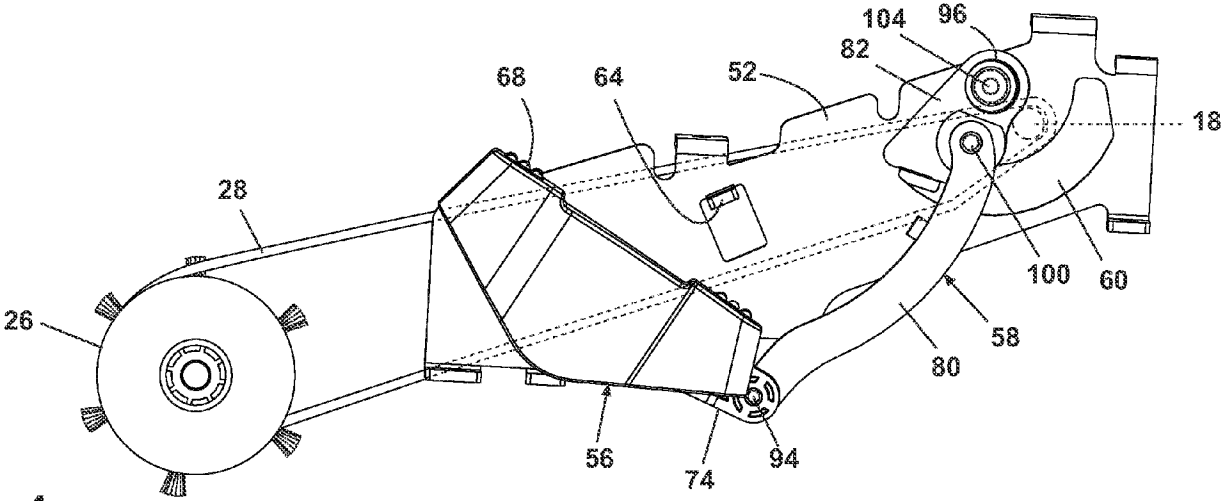
FIG. 4 is a right side view of the belt disengaging device from FIG. 2, illustrating the drive mechanism engaged with the brush.
Figure 5:
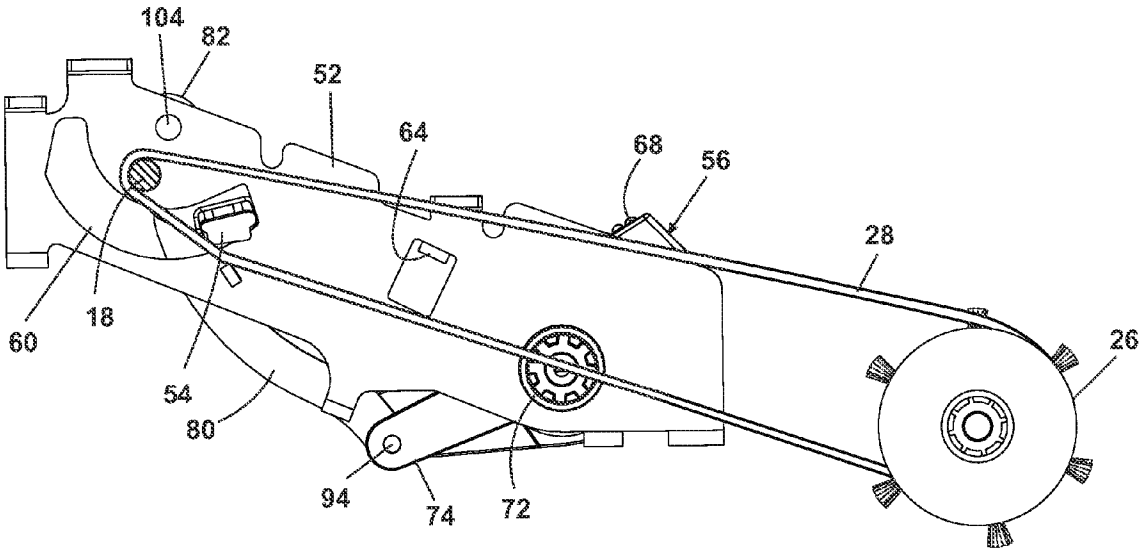
FIG. 5 is a left side view of the belt disengaging device from FIG. 2, illustrating the drive mechanism engaged with the brush.

When pressure is applied to the first portion 68, the shaft 72 rotates counter clockwise and the rear extension 74 pivots upwardly with respect to the orientation of FIG. 4. The pivoting motion of the rear extension 74 causes the link rod 80 to move generally rearwardly, with the first end 84 pivoting clockwise about the first pivot pin 94 and the second end 90 pivoting clockwise about the second pivot pin 100. The rearward movement of the link arm 80 is translated to rotational movement of the cam plate 82, whereby the cam plate 82 pivots counterclockwise about the third pivot pin 104, which causes the belt disengaging pin 54 to travel with the arcuate slot 60 from the position shown in FIGS. 4-5 to the position shown in FIGS. 6-7. As the belt disengaging pin 54 moves, it contacts the belt 28 and lifts it from engagement with the motor shaft 18, as can be seen in FIG. 7, thereby disengaging the belt drive mechanism. The pin 54 lays down relatively flat in the engaged position so that it hides comfortably between the spans of the belt 28, but it is relatively tall in the disengaged position to effectively lift the belt 28 clear of the motor shaft 18. The arced shape of the arcuate slot 60 and flat shape of the body 106 the pin 54 facilitates this function.

Figure 6:
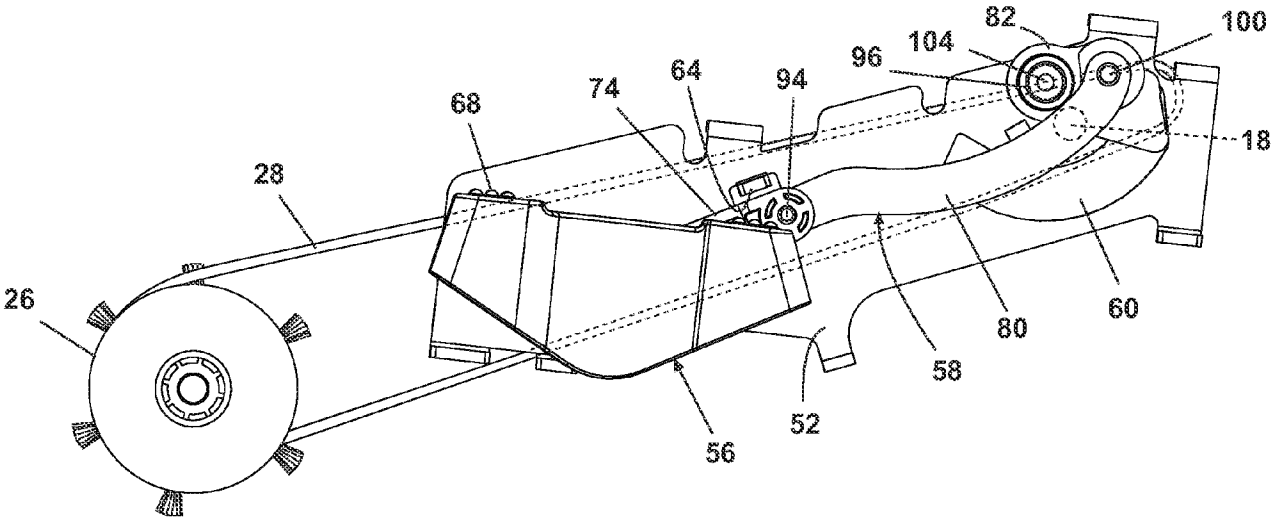
FIG. 6 is a right side view of the belt disengaging device from FIG. 2, illustrating the drive mechanism disengaged from the brush.
Figure 7:
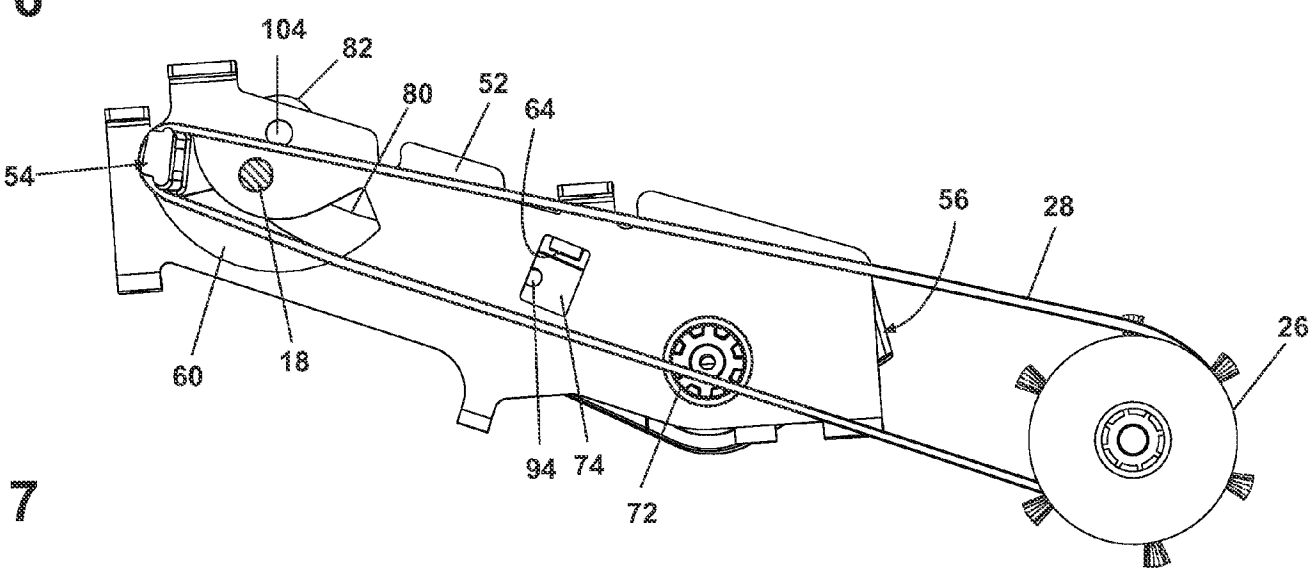
FIG. 7 is a left side view of the belt disengaging device from FIG. 2, illustrating the drive mechanism disengaged from the brush.

The first portion 68 or another part of the actuator 56 can have a detent device (not shown) to maintain the first portion 68 in the depressed position shown in FIGS. 6 and 7, thus maintaining the belt 28 in the disengaged position. Furthermore, while not illustrated, the belt disengaging pin 54 can alternately a bearing sleeve that freely rotates about a pin shaft, similar to the pin shown on the second embodiment of the belt disengaging device, described below.

Figure 8:
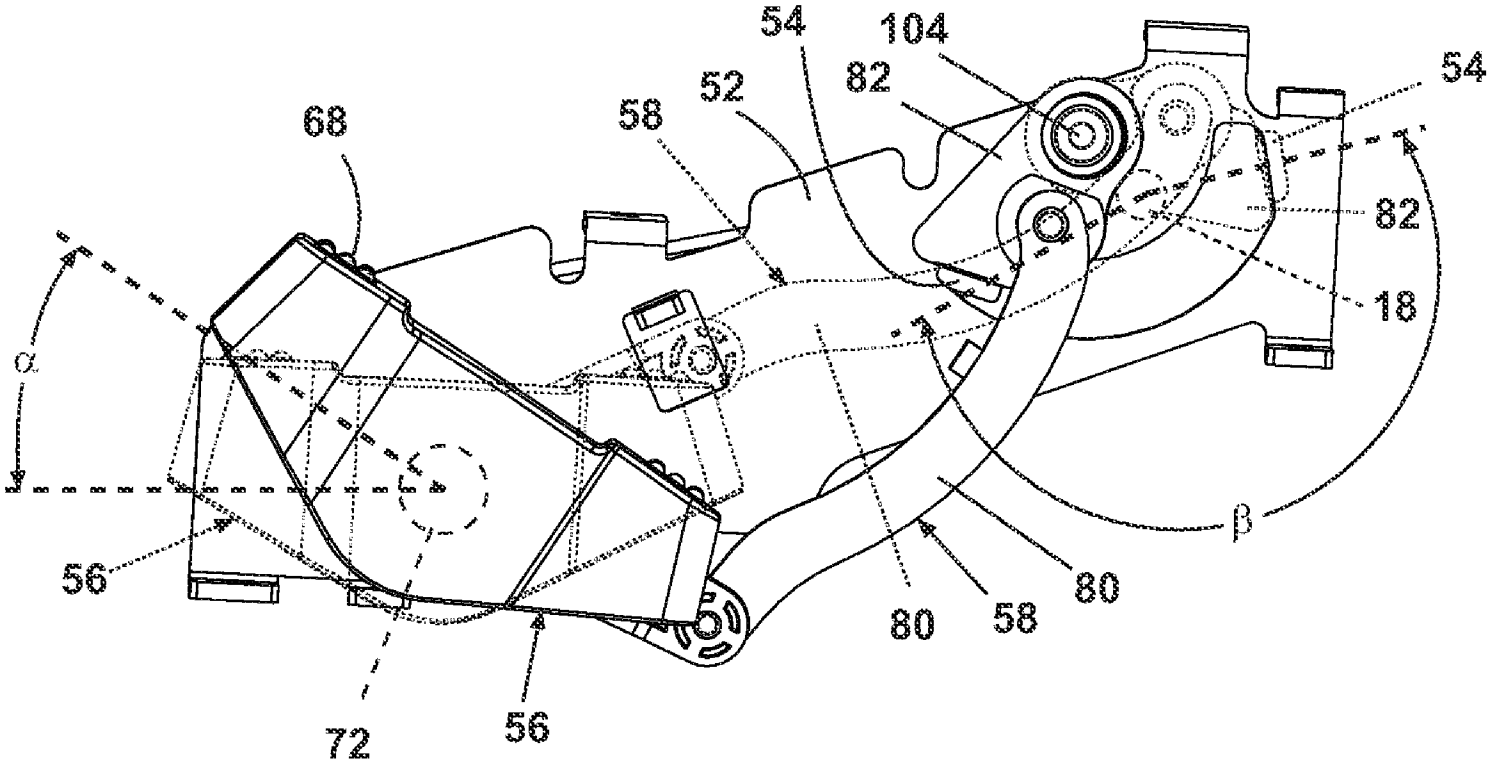
FIG. 8 is a side view of the belt disengaging device from FIG. 2, illustrating the movement of the device between an engaged and a disengaged position.

Referring to FIG. 8, when moving the belt 28 from the engaged position (shown in full lines) to the disengaged position (shown in phantom), the linkage 58 translates a rotational movement of the first portion 68 of the actuator 56 to arcuate pin movement about an angle $\beta$. Specifically, the first portion 68 rotates through an angle $\alpha$ about an axis longitudinally extending through the shaft 72, where $\alpha$ is less than 90°, to move the cam 82, and thus the pin 54 by virtue of its attachment to the cam 82, through an arc defined by a central angle $\beta$, where $\beta$ is greater than 90°, but less than 180° and from one side of the motor shaft 18 to the other by traversing an arc less than 180°. As is can be seen, disengagement of the belt 28 can be effected through relatively little movement supplied by the user to the foot pedal represented by the first portion 68, yet with a movement from one side of the motor shaft 18 to the other. This movement is possible because the arc of the pin 54 has a relatively large radius of curvature that is centered well above the axis of the motor shaft.

Figure 9:
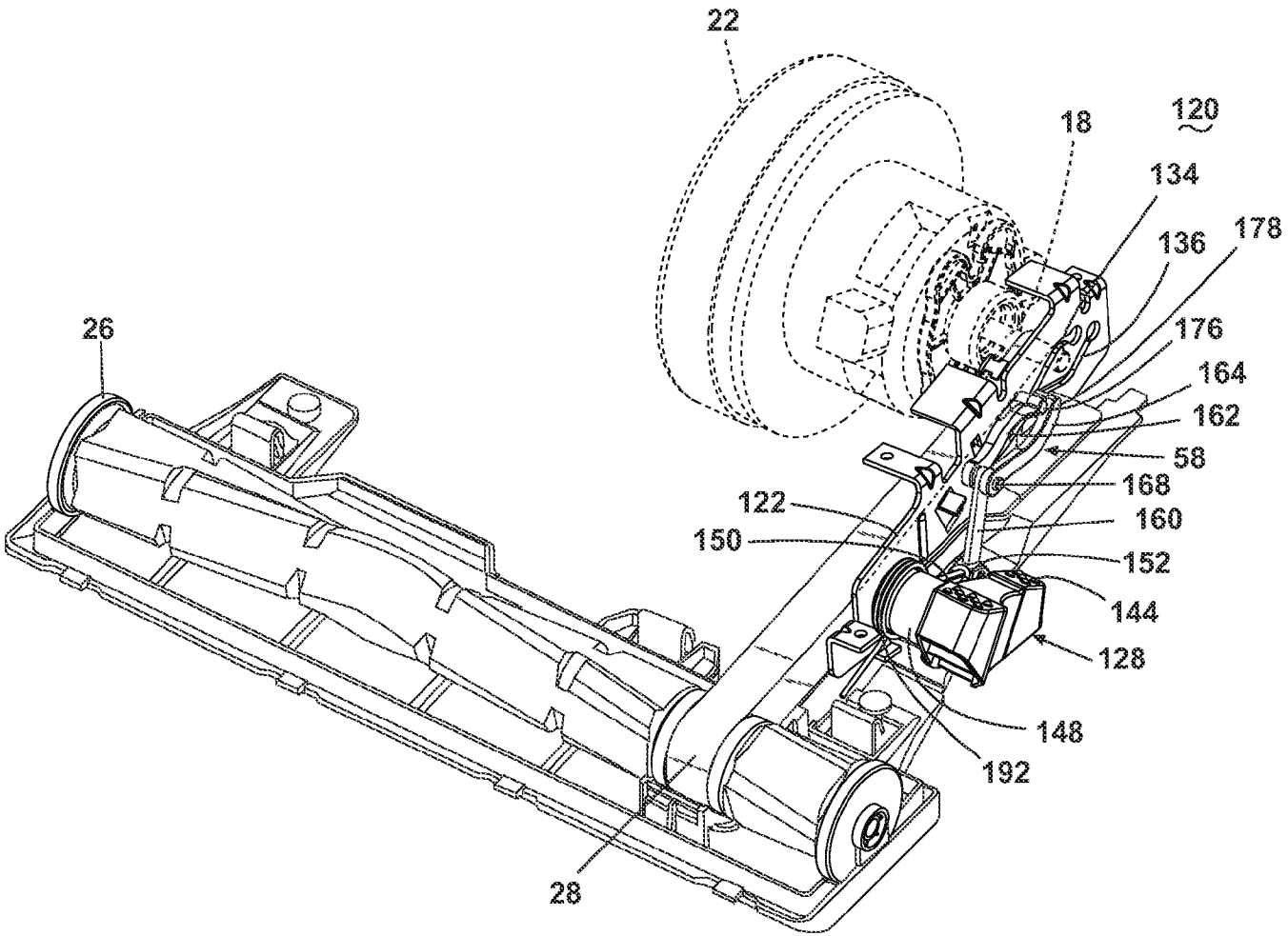
FIG. 9 is a front perspective view of a second embodiment of the belt disengaging device from FIG. 1.
Figure 10:
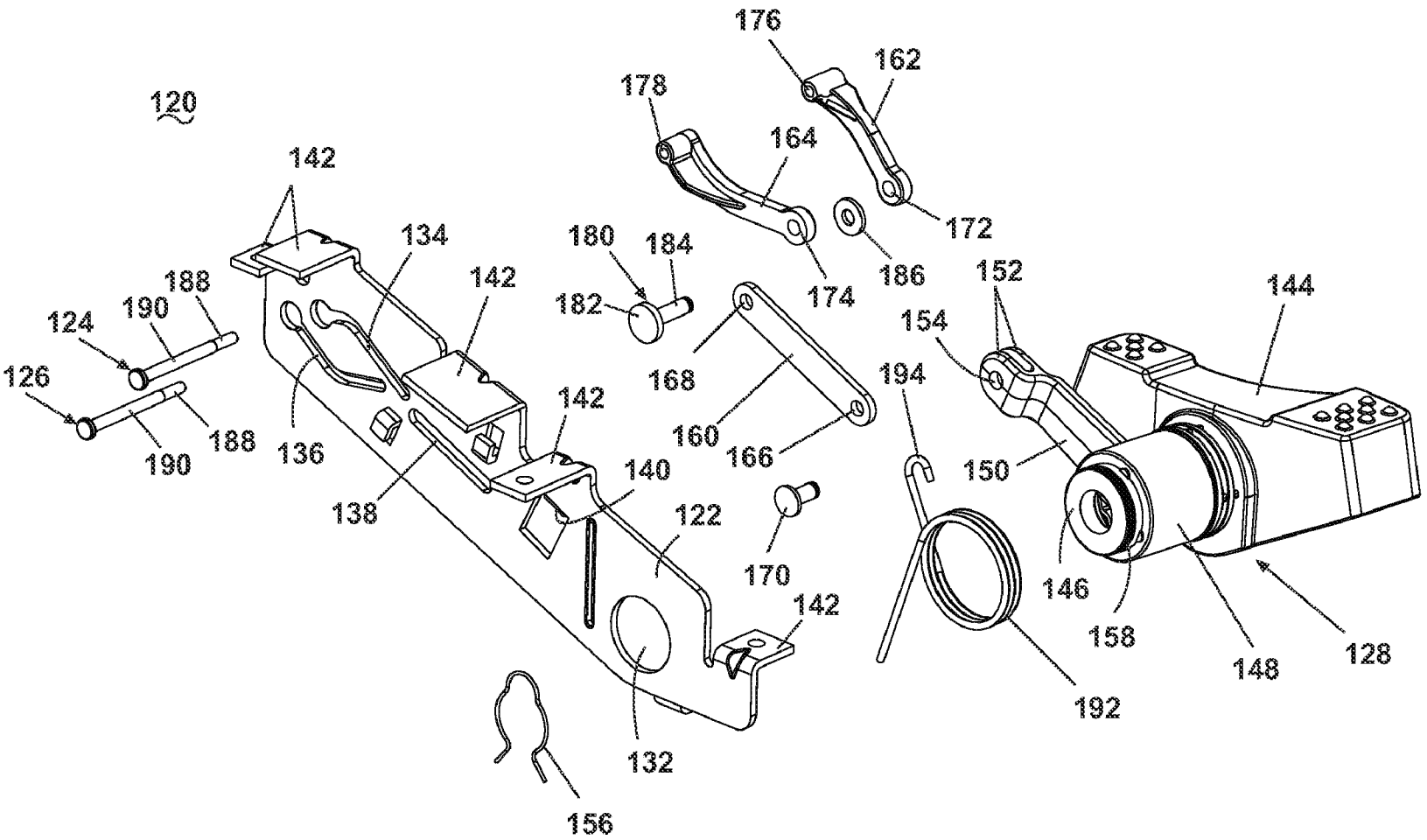
FIG. 10 is an exploded view of the belt disengaging device from FIG. 9

Referring to FIG. 9-15, a second embodiment of the belt disengaging device 120 according to the present invention is shown. Referring particularly to FIGS. 9-10, the belt disengaging device 120 generally comprises a bracket 122, a pair of belt disengaging pins 124, 126 for disengaging the belt 28 from the motor shaft 18, an actuator 128 for actuating the belt disengager 120, and a linkage 130 between the belt disengaging pins 124, 126 and the actuator 128.

The bracket 122 comprises a circular opening 132 formed near one end, an upper arcuate slot 134 and a lower arcuate slot 136 formed near an end opposite of the boss 132, and a linear guide track 138 formed between the boss 132 and the slots 134, 136. A tab 140 projects from one side of the bracket 122. The slots 134, 136, track 138, and the tab 140 limit the range of motion for the belt disengaging device 120. The circular opening 132 receives the actuator 128 for mounting to the bracket 122. The bracket 122 further comprises a plurality of flanges 142 that facilitate mounting the bracket 122 within the housing 20 of the base assembly 14 using screws (not shown). The bracket 122 generally supports the components of the belt disengaging device 120 within the base assembly 14.

The actuator 128 comprises a first portion 144 that projects exteriorly of housing 20 of the base assembly 14 and a second portion 146 that is interior of the housing 20. As illustrated, the first portion 144 conveniently comprises a foot pedal for actuation by the foot of the user. The second portion 146 comprises a hollow shaft 148 having a rear orthogonal extension 150 with a bifurcated end having two arms 152, each having a hole 154 formed therein. A spring 156 fits in a groove 158 formed in the shaft 148 to retain the shaft 148 within the circular opening 132 and rotatably couple the actuator 128 to the bracket 122.

The linkage 130 comprises a toggle link 160 and a pair of curved cam arms 162, 164. The toggle link 160 comprises a generally straight, flat member with a first hole 166 near one end of the member and a second hole 168 near the opposite end. The toggle link 160 is positioned between the arms 152 of the rear extension 150, with the holes 154, 166 aligned and receiving a first pivot pin 170 for pivotally coupling the rear extension 150 to the linkage 130. The cam arms 162, 164 comprise arcuate members, arranged in opposing fashion, with first holes 172, 174 respectively, near one end of the members and second holes 176, 178, respectively, near the opposite end. The cam arms 162, 164 are pivotally coupled to the toggle link 158 by a second pivot pin 180 extending through aligned holes 168, 172, and 174, with the toggle link 158 received between the cam arms 162, 164.

The second pivot pin 180 comprises an enlarged head 182 connected to a shank 184. A washer 186 is disposed between the bracket 122 and the cam arm 162. The shank 184 is slidingly received in the linear guide track 138, with the head 182 and washer 186 abutting the bracket 122 on either side.

The belt disengaging pins 124, 126 each comprise a pin shaft 188 and a bearing 190 that freely rotates about the pin shaft 188. The cam arms 162, 164 each comprise one of the belt disengaging pins 124, 126. Specifically, the second hole 176 on the upper cam arm 162 receives the first belt disengaging pin 124 and the second hole 178 on the lower cam arm 164 receives the second belt disengaging pin 126. The belt disengaging pin 124 is slidingly received in the upper arcuate slot 134, and the belt disengaging pin 126 is slidingly received in the lower arcuate slot 136.

Figure 11:
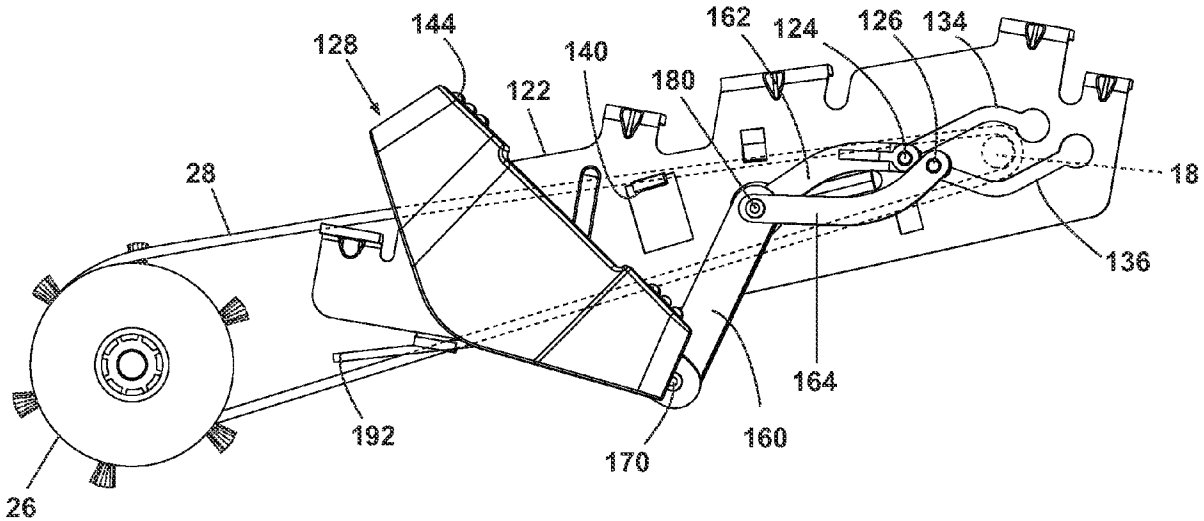
FIG. 11 is a right side view of the belt disengaging device from FIG. 9, illustrating the drive mechanism engaged with the brush.
Figure 12:
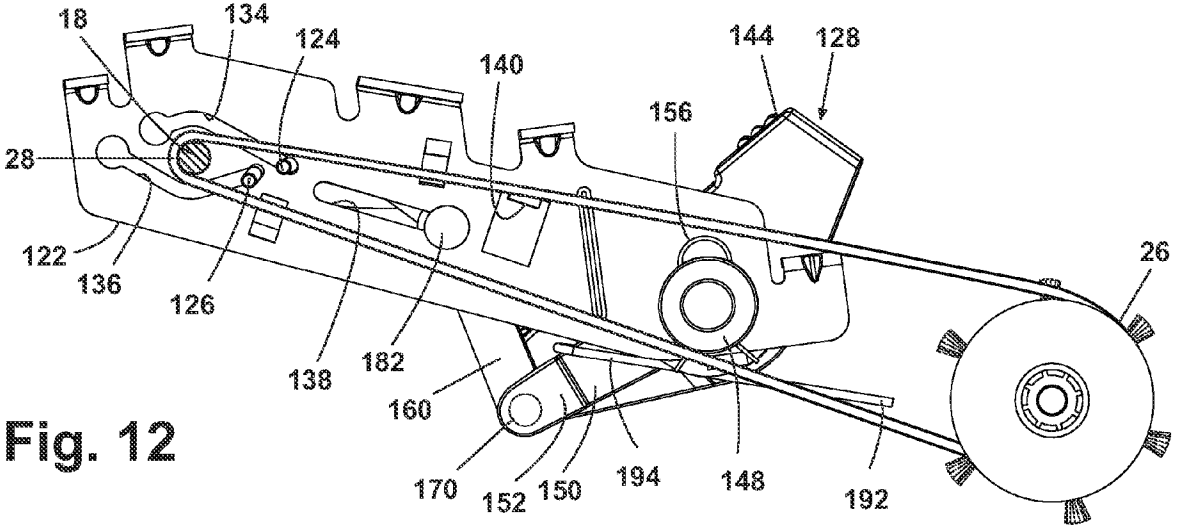
FIG. 12 is a left side view of the belt disengaging device from FIG. 9, illustrating the drive mechanism engaged with the brush.
Figure 13:
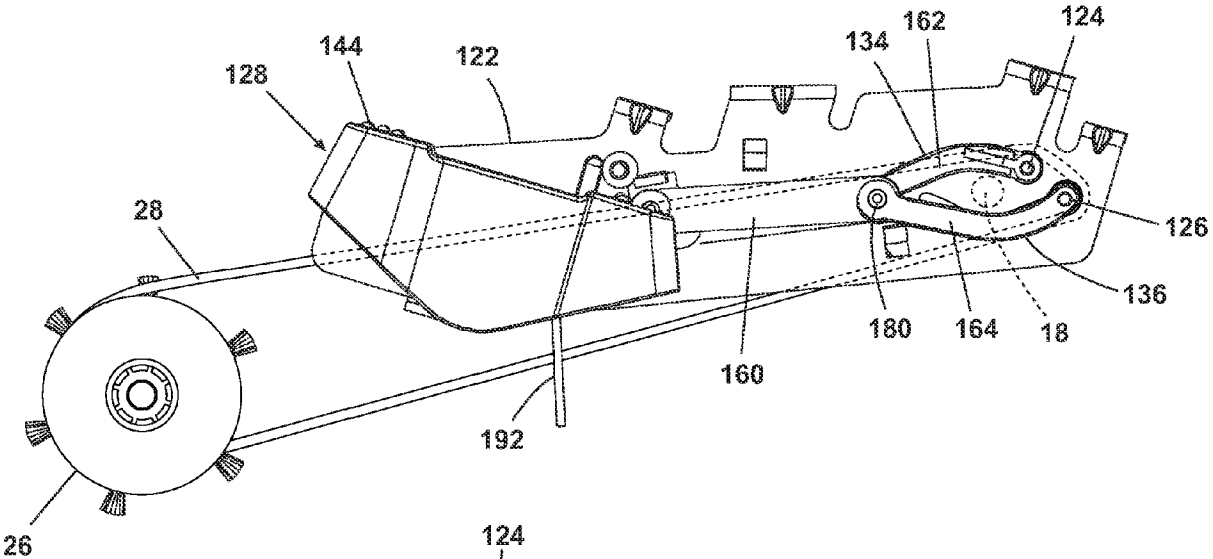
FIG. 13 is a right side view of the belt disengaging device from FIG. 9, illustrating the drive mechanism disengaged from the brush.

A spring 192 on the shaft 148 of the actuator 128 comprises an arm portion 194 that wraps around the rear extension 150 and biases the actuator 128, and thus the entire belt disengager 120, to the position shown in FIGS. 11 and 12, wherein the belt 28 is engaged with the motor shaft 18 and transmitting rotation movement to the agitator 26.

Referring to FIG. 9, a belt guide 196 is provided on an upper portion (not shown) of the housing 20 adjacent the belt 28, and prevents the belt 28 slipping off the belt disengaging pins 124, 126 when moving between an engaged and disengaged position.

Figure 14:
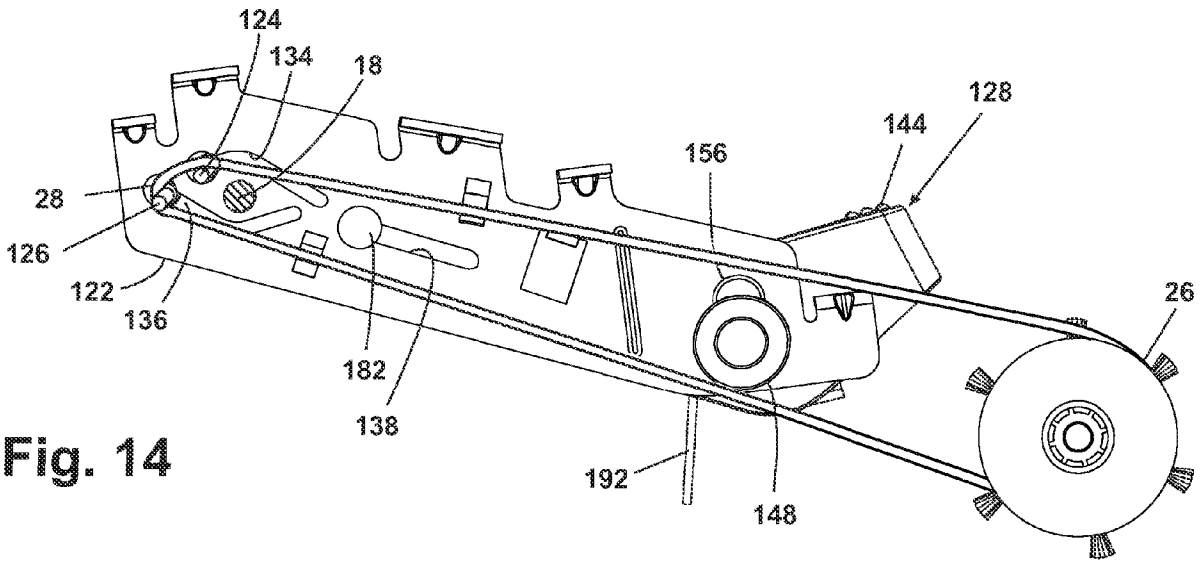
FIG. 14 is a left side view of the belt disengaging device from FIG. 9, illustrating the drive mechanism disengaged from the brush.

When pressure is applied to the first portion 144 of the actuator 128, the shaft 148 rotates counterclockwise and the rear extension 150 pivots upwardly with respect to the orientation of FIG. 11. The pivoting motion of the rear extension 150 causes the toggle links 160 to pivot clockwise about the first pivot pin 170 and the second pivot pin 180; however, because the second pivot pin 180 is constrained within the linear guide track 138, the second pivot pin 180 will also slide generally rearwardly within the linear guide track 138. This linear movement in turn causes the cam arms 162, 164 to slide within their respective arcuate slots 134, 136, from the position shown in FIGS. 11-12 to the position shown in FIGS. 13-14. As the cam arms 162, 164 move, the belt disengaging pins 124, 126 contact the belt 28 and lift it from engagement with the motor shaft 18, as can be seen in FIG. 14, thereby disengaging the belt drive mechanism. The first potion 144 or another portion of the actuator 128 can have a detent device (not shown) to maintain the first potion 144 in the depressed position shown in FIGS. 13-14 and thus maintain the belt in the disengaged position.

Figure 15A:
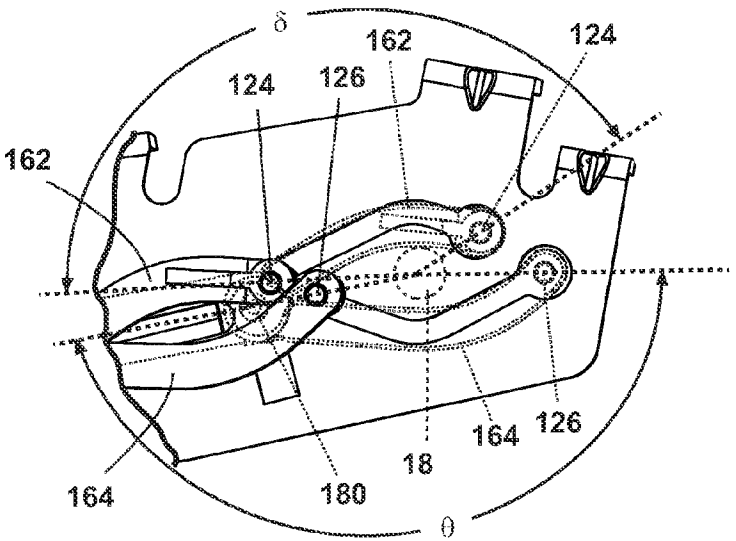

Referring to FIGS. 15-15A, when moving the belt 28 from the engaged position (shown) to the disengaged position (shown in phantom), the mechanics of the linkage 130 allows a rotational movement of the first portion 144 of the actuator 128 to be translated to arcuate pin movement. Specifically, the first portion 144 rotates an angle γ about an axis longitudinally extending through the shaft 148, where γ is less than 90°, to move each pin 124, 126 through roughly equal arcs having central angles δ and θ, respectively, where δ and θ and are both greater than 90°, but less than 180°. As was the case for the first embodiment of the belt disengaging device, disengagement of the belt 28 can be effected by the second embodiment through relatively little movement supplied by the user, yet with a movement of the belt disengaging pins 124, 126 from one side of the motor shaft 18 to the other along a relatively linear path. In this movement between the engaging and disengaging positions, the belt disengaging pins 124, 126 both move along arcs 134, 136, respectively, that have a relative large radius of curvature, with a radial center well above or well below the bracket 122 and well above and well below the motor shaft 18. Thus, the movement of the disengaging pins 124, 126 is relatively linear and close to the motor shaft 18, yet the radial center of the arc is much larger that the distance between the arcs 134 136 and the motor shaft 18.

While the belt disengaging device of the invention has been specifically described in connection with certain specific embodiments thereof, it is to be understood that this is by way of illustration and not of limitation. Reasonable variation and modification are possible within the foregoing description and drawings without departing from the spirit of the invention which is defined by the appended claims.

What is claimed is:

1. A vacuum cleaner comprising:

a base assembly having a housing, a suction nozzle, and a rotatable agitator;

a motor-driven belt drive for the rotatable agitator comprising a motor shaft and a belt coupling the motor shaft to the rotatable agitator;

a suction source in fluid communication with the suction nozzle; and a belt drive disengaging assembly, comprising:

a bracket mounted within the housing;

a pin associated with the bracket and constrained for movement through an arc of no more than substantially less than 180° between an engaged position, where the motor shaft is coupled to the agitator in a driving relationship with the belt, and a disengaged position, where the pin lifts the belt off the motor shaft and uncouples the agitator from a driving relationship with the motor shaft;

an actuator mounted to the bracket for movement between a first and a second position, and including a first portion positioned exterior of the housing for user access and a second portion positioned interior of the housing; and a linkage pivotally connected to the actuator and mechanically coupled to the pin to move the pin between the engaged and disengaged positions, upon the actuator moving between the first and second positions, respectively.

2. The vacuum cleaner according to claim 1 wherein the first portion of the actuator comprises a foot pedal.

3. The vacuum cleaner according to claim 2 wherein the second portion of the actuator is pivotally coupled with the linkage.

4. The vacuum cleaner according to claim 1 wherein the actuator is pivotally mounted to the bracket for movement between the first and second position by rotation of the first portion about an axis.

5. The vacuum cleaner according to claim 1 wherein the actuator rotates less than 90° about the axis when moving between the first and second position.

6. The vacuum cleaner according to claim 1 wherein the pin comprise a shaft and a bearing sleeve that is rotatably mounted to the shaft and adapted to engage the belt and rotate with the movement of the belt.

7. The vacuum cleaner according to claim 1 wherein the linkage comprises a link having a first end pivotally connected to the actuator and a second end pivotally connected to a cam and the pin is mounted to the cam.

8. The vacuum cleaner according to claim 7 wherein the pin is guided in a slot formed in the bracket for movement between the engaged and disengaged positions.

9. The vacuum cleaner according to claim 8, wherein the second end of the link is further pivotally connected to a second cam mounting a second pin associated with the bracket, the second pin being moveable between the engaged position and the disengaged position, where the second pin lifts the belt off the motor shaft contemporaneously with the first pin.

10. The vacuum cleaner according to claim 9 wherein the first and second cams are pivotally connected to the link by a pivot pin guided in a third slot formed in the bracket.

11. The vacuum cleaner according to claim 9 wherein the first and second pins each comprise a shaft and a bearing roller mounted to the shaft and adapted to engage the belt.

12. The vacuum cleaner according to claim 9 wherein the second pin is guided in a second slot formed in the bracket for movement between the engaged and disengaged positions.

13. The vacuum cleaner according to claim 12 wherein the first and second slots are formed in the bracket on opposite sides of the motor shaft.

14. The vacuum cleaner according to claim 7 wherein the cam is pivotally connected to the bracket.

15. The vacuum cleaner according to claim 1 wherein the arc through which the pin moves has a radial center that is offset from the rotational axis of the motor shaft.

16. A vacuum cleaner comprising:

a base assembly having a housing, a suction nozzle, and a rotatable agitator;

a motor-driven belt drive for the rotatable agitator comprising a motor shaft and a belt coupling the motor shaft to the rotatable agitator;

a suction source in fluid communication with the suction nozzle; and a belt drive disengaging assembly, comprising:

a bracket mounted within the housing;

a pin associated with the bracket and moveable through an arc of substantially less than 180° between an engaged position, where the motor shaft is coupled to the agitator through the belt, and a disengaged position, where the pin disengages the belt from the motor shaft;

an actuator mounted to the bracket for movement between a first and a second position, and including a first portion positioned exterior of the housing for user access and a second portion positioned interior of the housing; and a linkage pivotally connected to the actuator and mechanically coupled to the pin to move the pin between the engaged and disengaged positions, upon the actuator moving between the first and second positions, respectively;

wherein the linkage comprises a link having a first end pivotally connected to the actuator and a second end pivotally connected to a cam, the pin is mounted to the cam and the cam is pivotally connected to the bracket through a pivot axis that is offset from the rotational axis of the motor shaft.

17. The vacuum cleaner according to claim 16 wherein the pin comprises a body portion adapted to engage the belt and a winglet at an outer end of the body portion adapted to prevent the belt from slipping off the body portion.

18. The vacuum cleaner according to claim 16 wherein the pin is guided in a slot formed in the bracket for movement between the engaged and disengaged positions.

19. The vacuum cleaner according to claim 18 wherein the slot is concave toward the motor shaft.

20. A vacuum cleaner comprising:

a base assembly having a housing, a suction nozzle, and a rotatable agitator;

a motor-driven belt drive for the rotatable agitator comprising a motor shaft and a belt coupling the motor shaft to the rotatable agitator;

a suction source in fluid communication with the suction nozzle; and a belt drive disengaging assembly, comprising:

a bracket mounted within the housing;

a pin associated with the bracket and constrained to move through an arc of no more than substantially less than 180° between an engaged position, where the motor shaft is coupled in a driving relationship with the agitator through the belt, and a disengaged position, where the pin lifts the belt off the motor shaft and disengages the belt from a driving relationship with the motor shaft, and wherein the pin is mounted to a cam and the cam is pivotally connected to the bracket through a pivot axis that is offset from the rotational axis of the motor shaft;

an actuator mounted to the bracket for movement between a first and a second position, and including a first portion positioned exterior of the housing for user access and a second portion positioned interior of the housing; and a linkage pivotally connected to the actuator and mechanically coupled to the pin to move the pin between the engaged and disengaged positions, upon the actuator moving between the first and second positions, respectively.

* * * * *

UNITED STATES PATENT AND TRADEMARK OFFICE

CERTIFICATE OF CORRECTION

PATENT NO. : 7,861,369 B2
APPLICATION NO. : 11/556522
DATED : January 4, 2011
INVENTOR(S) : Jonathan L. Miner and George Moyher It is certified that error appears in the above-identified patent and that said Letters Patent is hereby corrected as shown below:

On the Title Page

It reads: Item (63) Continuation-in-part of application No. PCT/US2006/02669...

It should read: Item (63) Continuation-in-part of application No. PCT/US2006/026696...

In column 1, line 8, it reads: ...Serial No. PCT/US2006/02669...

It should read: ...Serial No. PCT/US2006/026696...

Signed and Sealed this
Twenty-ninth Day of March, 2011

David J. Kappos

David J. Kappos
*Director of the United States Patent and Trademark Office*